US005715703A

United States Patent [19]

Kopf et al.

[11] Patent Number: 5,715,703

[45] Date of Patent: Feb. 10, 1998

[54] MULTIPLE FAN AIR DISTRIBUTION SYSTEM FOR APPLIANCES

[76] Inventors: Bruce A. Kopf, 1748 Sherbrook Dr. NE., Cedar Rapids, Iowa 52402; Lyle J. Berkenbosch, 3040 Third Ave., Marion, Iowa 52302; Les J. Ott, 325 Fourth St. SW., Swisher, Iowa 52338

[21] Appl. No.: 674,372

[22] Filed: Jul. 2, 1996

[51] Int. Cl.[6] ..... F25D 3/08; F25D 17/04

[52] U.S. Cl. ..... 62/455; 62/408; 62/186

[58] Field of Search ..... 62/404, 407, 408, 62/441, 455, 186

[56] References Cited

U.S. PATENT DOCUMENTS

| | | | |
|---|---|---|---|
| 2,863,300 | 12/1958 | Murphy et al. | 62/408 |
| 2,866,323 | 12/1958 | Candor | 62/408 |
| 3,050,956 | 8/1962 | Mann et al. | 62/408 |
| 3,093,981 | 6/1963 | O'Grady | 62/408 |
| 3,096,629 | 7/1963 | Rembold | 62/407 |
| 3,126,721 | 3/1964 | Shove | 62/408 |
| 3,321,933 | 5/1967 | Scheitlin et al. | 62/408 |
| 3,403,533 | 10/1968 | Bollenbacher | 62/408 |
| 3,851,496 | 12/1974 | Rupert | 62/406 |
| 4,924,680 | 5/1990 | Janke et al. | 62/187 |
| 5,065,592 | 11/1991 | Takano et al. | 62/180 |

*Primary Examiner*—William Doerrler
*Attorney, Agent, or Firm*—Sarah L. Byrne; Glenn H. Lenzen

[57] ABSTRACT

A refrigerator has fresh food and freezer compartments, and each of the fresh food and freezer compartments has upper and lower portions. A first air duct extends from the upper portion of the freezer compartment to the upper portion of the fresh food compartment, and a second air duct extends between the lower portion of the freezer compartment and the lower portion of the fresh food compartment. A first fan is arranged to draw first air through the first air duct from the upper portion of the freezer compartment and to discharge the first air into the upper portion of the fresh food compartment. A second fan is arranged to draw second air from the lower portion of freezer compartment and to discharge the second air into the upper portion of the freezer compartment.

34 Claims, 5 Drawing Sheets

MULTIPLE FAN AIR DISTRIBUTION SYSTEM FOR APPLIANCES

TECHNICAL FIELD OF THE INVENTION

The present invention is directed to an air distribution system for distributing air through an appliance such as a refrigerator.

BACKGROUND OF THE INVENTION

A refrigerator, particularly a refrigerator used in consumer applications, typically includes both a fresh food compartment and a freezer compartment. Such a refrigerator also includes an evaporator coil, a condenser coil, a compressor, and a refrigerator fan. The evaporator coil, condenser coil, and compressor are interconnected by fluid conduits which carry a heat exchange fluid. The compressor compresses the heat exchange fluid and supplies the compressed heat exchange fluid to the evaporator coil where the compressed heat exchange fluid is evaporated. The evaporation of the heat exchange fluid in the evaporator coil cools the evaporator coil. The refrigerator fan blows air across the cool evaporator coil in order to cool the air, and then discharges the cooled air to the freezer compartment. Accordingly, the evaporator coil removes heat from the air which is blown across the evaporator coil by the refrigerator fan.

The removed heat is then transferred by the heat exchange fluid to the condenser coil. A condenser fan blows air across the condenser coil in order to reject the heat of the heat exchange fluid to atmosphere. The refrigerator fan, the compressor, and the compressor fan are controlled by a temperature sensor in the freezer compartment.

The air discharged by the refrigerator fan into the freezer compartment is also supplied to the fresh food compartment. A typical refrigerator employs a mechanical or bellows type damper in order to control this air flow from the freezer compartment to the fresh food compartment. The position of the damper is controlled by a temperature sensor in the fresh food compartment so that the position of the damper controls the temperature of the fresh food compartment. However, a damper is slow to respond to control signals and, thus, permits unnecessarily large temperature swings within the fresh food compartment. Also, the use of a single refrigerator fan to supply cooled air to both the freezer and fresh food compartments requires the refrigerator fan speed to be relatively high, and this high fan speed increases the noise of operating the refrigerator. Moreover, the refrigerator fan is usually driven by an AC motor which consumes a large amount of energy.

The present invention is intended to solve one or more of the above-noted problems.

SUMMARY OF THE INVENTION

According to a first aspect of the present invention, a multiple fan air distribution system for a refrigerator comprises first and second air discharging means and connecting means. The first air discharging means discharges cooled air to a first refrigeration compartment of a refrigerator, and the first air discharging means includes a first fan. The second air discharging means discharges cooled air to a second refrigeration compartment of the refrigerator, and the second air discharging means includes a second fan. The connecting means interconnects the first and second refrigeration compartments so that the first air discharging means discharges air from the second refrigerator compartment to the first refrigeration compartment, so that the first air discharging means discharges air to the first refrigeration compartment but not to the second refrigeration compartment, and so that the second air discharging means discharges air to the second refrigeration compartment but not to the first refrigeration compartment.

According to another aspect of the present invention, a refrigerator having a multiple fan air distribution system comprises a refrigerator cabinet and first and second fans. The refrigerator cabinet has first and second refrigeration compartments. The first fan is located in the first refrigeration compartment and is arranged to draw cooled air from the second refrigeration compartment and to discharge the drawn cooled air to the first refrigeration compartment. The second fan is located in the second refrigeration compartment and is arranged to discharge cooled air to the second refrigeration compartment.

According to yet another aspect of the present invention, a refrigerator comprises a refrigerator cabinet, a first air duct, a second air duct, a first fan, and a second fan. The refrigerator cabinet has first and second refrigeration compartments, and each of the first and second refrigeration compartments has upper and lower portions. The first air duct extends from the upper portion of the second refrigeration compartment to the upper portion of the first refrigeration compartment. The second air duct extends between the upper portion of the second refrigeration compartment and the lower portion of the first refrigeration compartment. The first fan is arranged to draw first air through the first air duct from the upper portion of the second refrigeration compartment and to discharge the first air into the upper portion of the first refrigeration compartment. The second fan is arranged to draw second air from the lower portion of second refrigeration compartment and to discharge the second air into the upper portion of the second refrigeration compartment.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
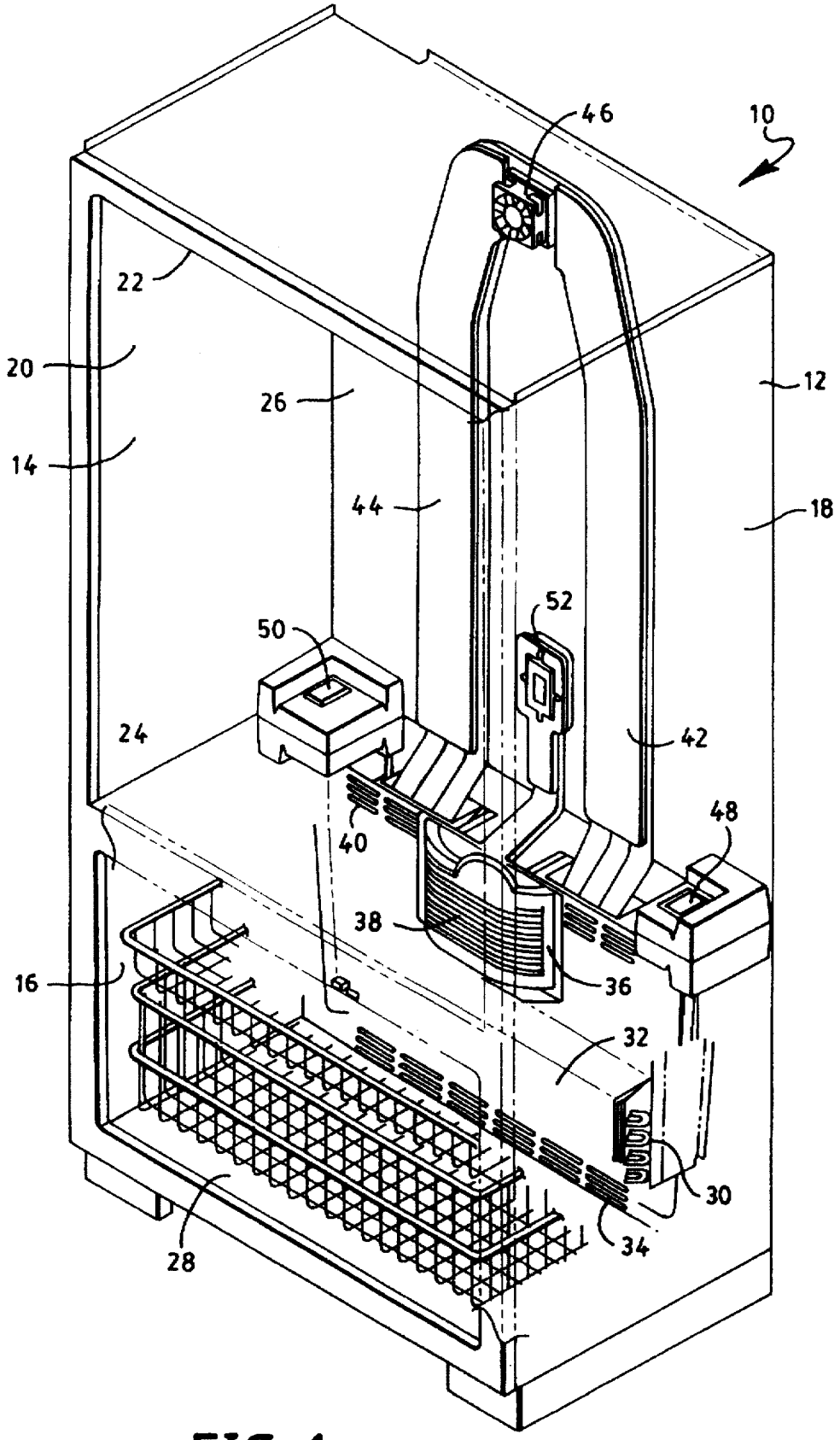
FIG. 1 is an isometric view of a refrigerator having a multiple fan air distribution system according to the present invention.
Figure 2:
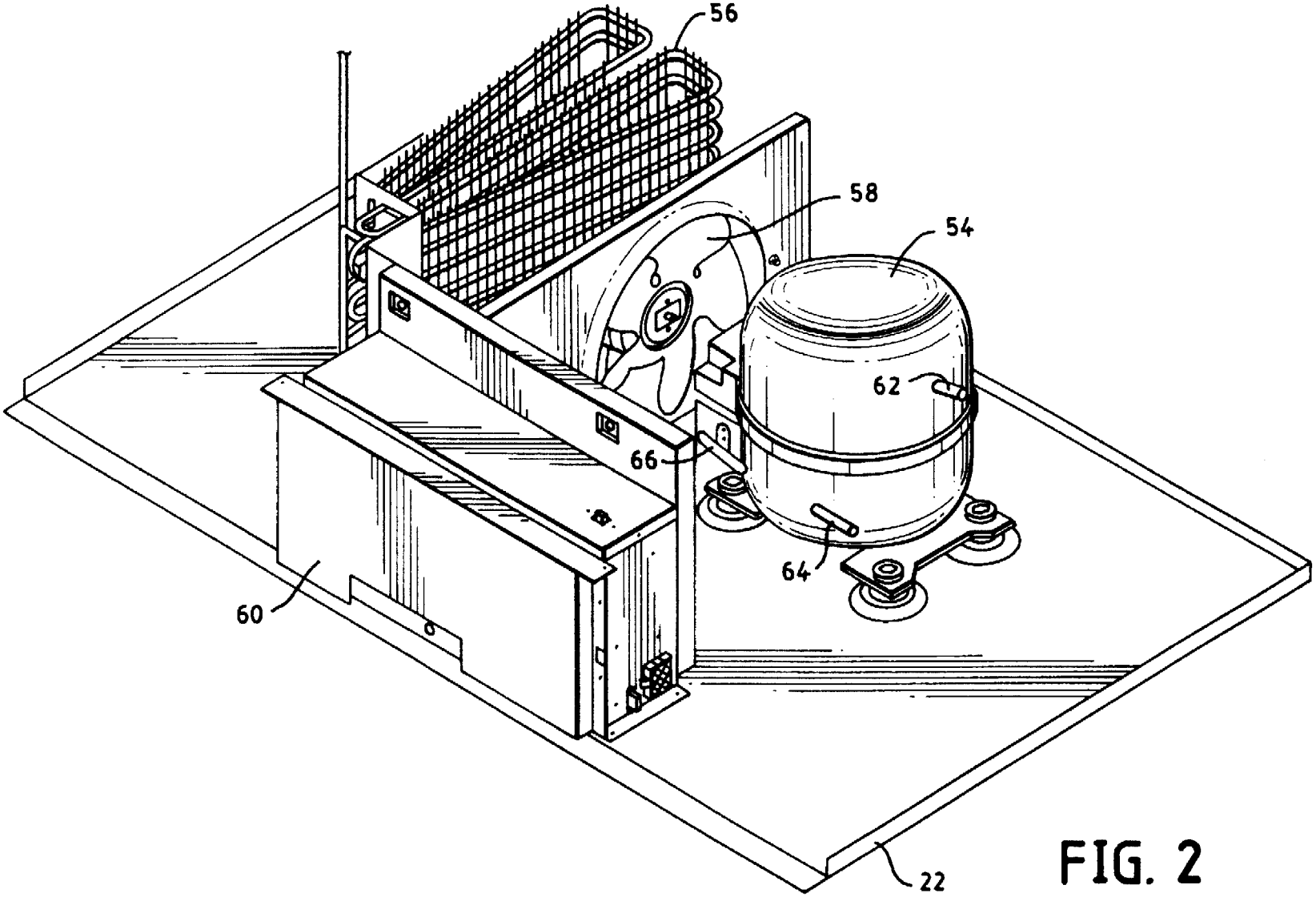
FIG. 2 is an isometric view of a compressor compartment which may be located on top of the refrigerator shown in FIG. 1.
Figure 3:
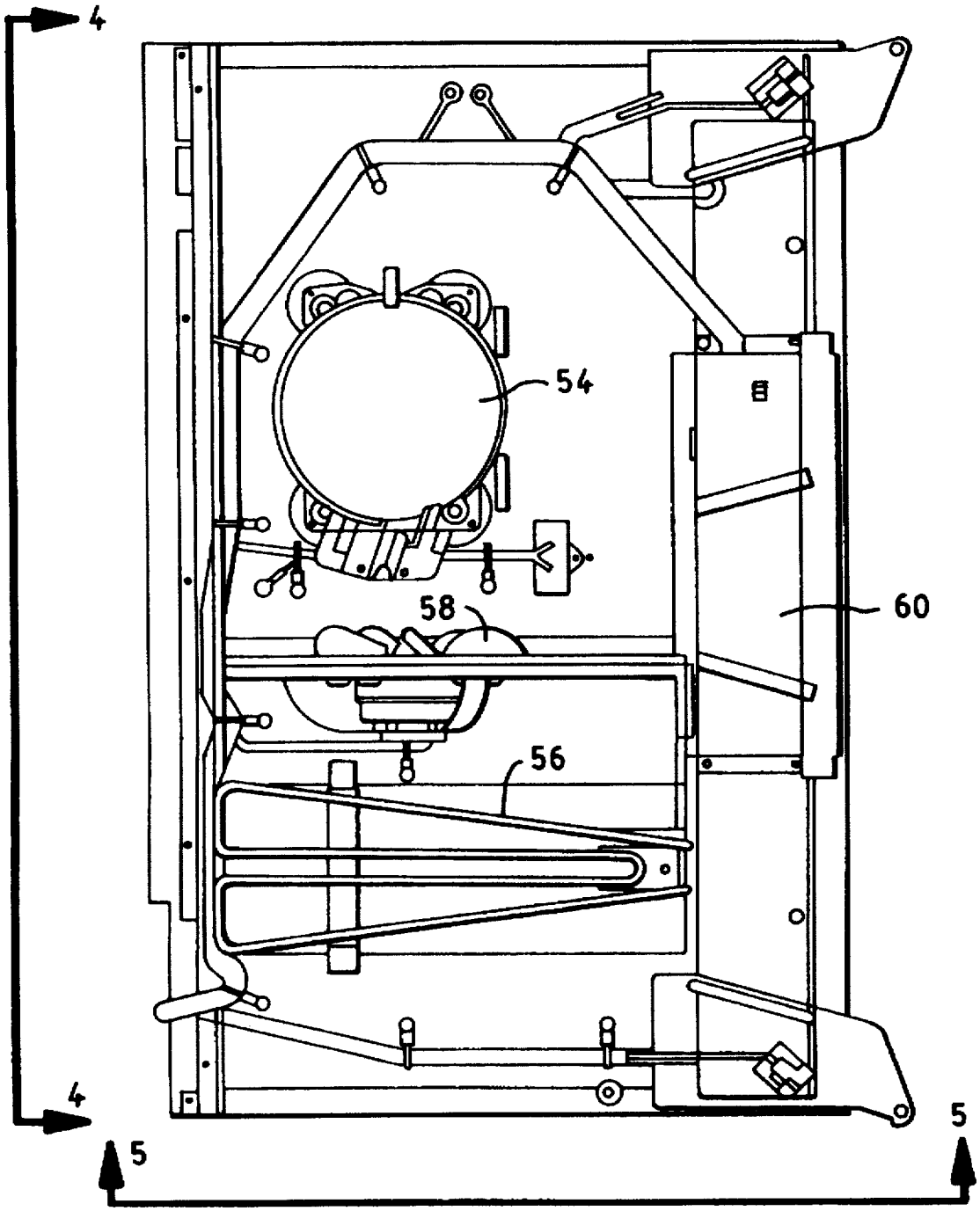
FIG. 3 is a top view of the compressor compartment shown in FIG. 1.
Figure 4:
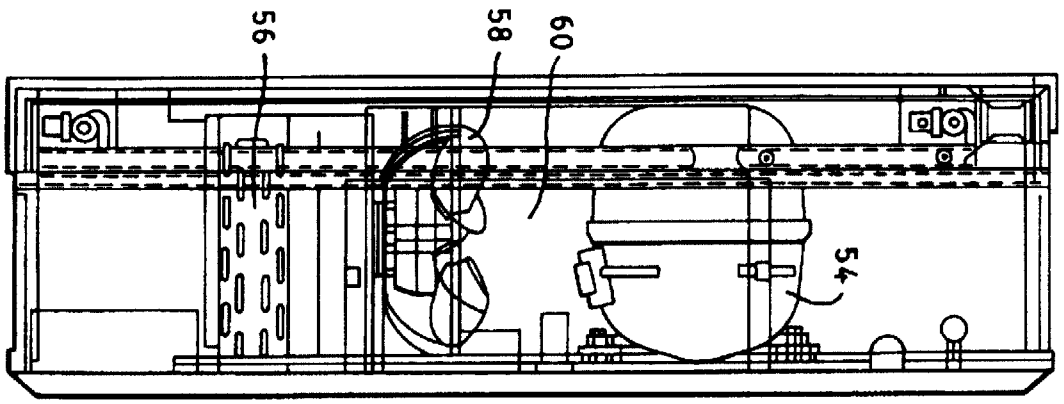
FIG. 4 is a view taken along line 4—4 FIG. 3.
Figure 5:
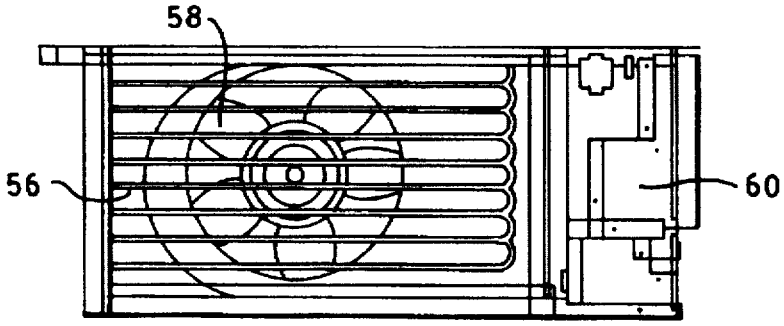
FIG. 5 is a view taken along line 5—5 FIG. 3.

As shown in FIG. 1, a refrigerator 10 includes a refrigerator cabinet 12 which houses a fresh food compartment 14 and a freezer compartment 16. The fresh food compartment 14 is bounded by refrigerator cabinet side walls 18 and 20, a top wall 22, a fresh food compartment floor 24, a back wall 26, and a fresh food compartment door (not shown). Similarly, the freezer compartment 16 is bounded by the refrigerator cabinet side walls 18 and 20, the fresh food compartment floor 24 of the fresh food compartment 14, the back wall 26, a freezer compartment floor 28 of the freezer compartment 16, and a freezer compartment door (not shown).

An evaporator coil 30 is housed by an evaporator coil housing 32 within the freezer compartment 16. The evaporator coil housing 32 includes air return vents 34 which permit air to be returned from a lower portion of the freezer compartment 16 to the evaporator coil 30. The top of the evaporator coil housing 32 communicates with a fan housing 36 which houses an AC fan. The fan housing 36 includes air discharge vents 38 which are located in an upper portion of the freezer compartment 16. The refrigerator cabinet side wall 18, the top wall 22, and the fresh food compartment floor 24 are shown in phantom in FIG. 1 in order to better show the evaporator coil 30, the evaporator coil housing 32, the air return vents 34, the fan housing 36, and the air discharge vents 38.

When the AC fan, which is housed within the fan housing 36, is energized, air is drawn from the lower portion of the freezer compartment 16 through the air return vents 34 and over the evaporator coil 30. The evaporator coil 30 cools the air, and the cooled air is discharged by the AC fan from the fan housing 36 through the air discharge vents 38 and into the upper portion of the freezer compartment 16. This discharged air falls over the frozen foods to the lower portion of the freezer compartment 16.

The back wall 26 has air inlet vents 40 just below the fresh food compartment floor 24 so that the air inlet vents 40 are in communication with the freezer compartment 16. In communication with the air inlet vents 40 are a pair of air supply ducts 42 and 44 which conduct air flow from the freezer compartment 16 to an upper portion of the fresh food compartment 14. The air supply ducts 42 and 44 communicate with a DC fan 46. A pair of air return ducts 48 and 50 extend through the fresh food compartment floor 24. Accordingly, communication between a lower portion of the fresh food compartment 14 and the lower portion of the freezer compartment 16 is established through the air return ducts 48 and 50 which permit the return of air from the fresh food compartment 14 to the freezer compartment 16.

When energized, the DC fan 46 draws air from the upper portion of the freezer compartment 16 through the air inlet vents 40 and through the air supply ducts 42 and 44. The DC fan 46 then discharges the air into an upper portion of the fresh food compartment 14. Accordingly, cool air is drawn by the DC fan 46 from the freezer compartment 16 and is discharged into the upper portion of the fresh food compartment 14. This cool air falls over the fresh food in the fresh food compartment 14 and returns to the freezer compartment 16 through the air return ducts 48 and 50.

If desired, a beverage air duct 52 may be provided in order to supply cooled air to a beverage compartment.

As shown in FIGS. 2–5, a compressor 54, a condenser coil 56, a condenser fan 58, and a control box 60 are mounted on top of the top wall 22 of the refrigerator 10. The evaporator coil 30, the condenser coil 56, and the compressor 54 are connected in a fluid circuit by fluid conduits 62, 64, 66, etc. Accordingly, a heat exchange fluid is compressed and is circulated through the fluid conduits of this fluid circuit by the compressor 54. The compressor 54 supplies the compressed heat exchange fluid to the evaporator coil 30 where the heat exchange fluid evaporates to cool the air which is circulated across the evaporator coil 30 by the AC fan contained in the fan housing 36. The heat exchange fluid is then returned by the fluid circuit to the condenser coil 56 where the heat picked up by the high exchange fluid in the evaporator coil 30 is rejected to atmosphere by the air being circulated across the condenser coil 56 by the condenser fan 58.

Figure 6:
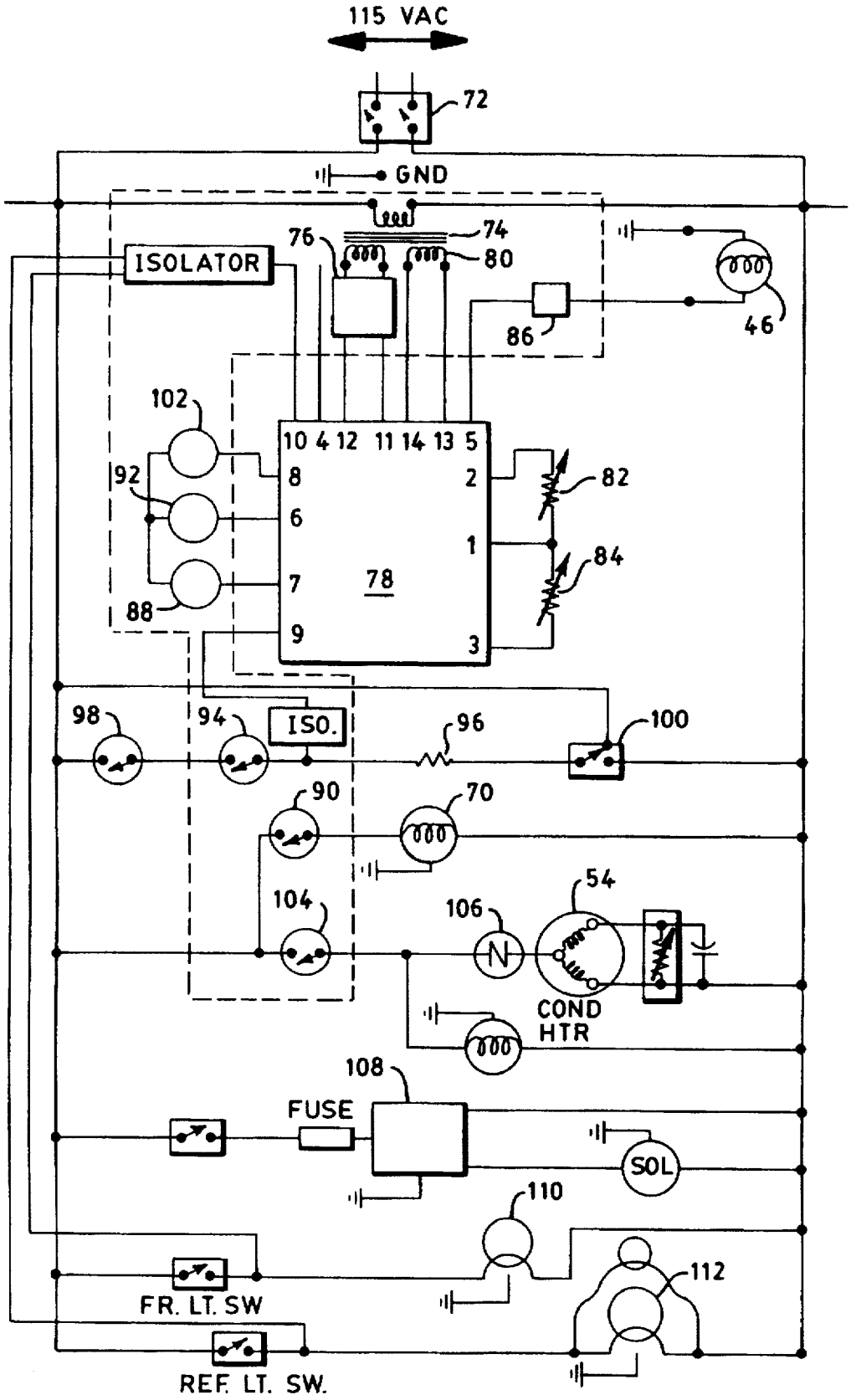
FIG. 6 is a schematic diagram of a controller for the multiple fan air distribution system according to the present invention.

A control circuit for the refrigerator 10 is contained in the control box 60 and is shown in FIG. 6. FIG. 6 illustrates an AC evaporator fan 70 as the evaporator fan which is contained within the fan housing 36 and which circulates air from the lower portion of the freezer compartment 16, through the air return vents 34, over the evaporator coil 30, through the air discharge vents 38, and into the upper portion of the freezer compartment 16.

As shown in FIG. 6, power is supplied to the refrigerator 10 through a pair of power mains and a main power switch 72. A transformer 74 and a power supply rectifier and bridge 76 are connected across the power mains in order to supply low voltage DC to an electronic control 78. Also, a secondary winding 80 of the transformer 74 is arranged to supply AC to the electronic control 78. The electronic control 78 may be supplied by the assignee of the present invention under Amana part No. 12067101.

The electronic control 78 responds to a thermistor 82, which may be located so as to sense the temperature in the freezer compartment 16, and a thermistor 84, which may be located so as to sense the temperature in the fresh food compartment 14. When the electronic control 78 determines from the thermistor 84 that additional cooling is needed in the fresh food compartment 14, the electronic control 78 operates a semi-conductor switch 86 in order to energize the DC fan 46. When the DC fan 46 is energized, air is circulated by the DC fan 46 from the upper portion of the freezer compartment 16, through the air inlet vents 40, through the air supply ducts 42 and 44, and out into the upper portion of the fresh food compartment 14. Air is returned from the fresh food compartment 14 to the freezer compartment 16 through the air return ducts 48 and 50.

When the electronic control 78 determines from the thermistor 82 that the freezer compartment 16 requires additional cooling, the electronic control 78 energizes a relay 88 which closes a relay switch 90 in order to energize the AC evaporator fan 70. Accordingly, air is circulated by the AC evaporator fan 70 from the lower portion of the freezer compartment 16, through the air return vents 34, over the evaporator coil 30, and out through the air discharge vents 38 into the upper portion of the freezer compartment 16.

When the electronic control 78 determines that the evaporator coil 30 should be defrosted, the electronic control 78 operates a relay 92 which closes a relay switch 94 in order to energize a defrost heater 96. When the temperature of the evaporator coil 30 has reached a predetermined temperature as determined by a temperature sensor 98, the temperature sensor 98 causes the defrost heater 96 to be deenergized. A showroom switch 100 prevents operation of the defrost heater 96 when the refrigerator 10 is sitting on a showroom floor. When the refrigerator 10 is installed for operation, the showroom switch 100 is operated so as to place the temperature sensor 98, the relay switch 94, and the defrost heater 96 across the power mains of the refrigerator 10.

The electronic control 78 controls the compressor 54 through a relay 102, a relay switch 104, and an overload protector 106. An ice maker 108, a freezer compartment light 110, and a fresh food compartment light 112 may also be operated under control of corresponding switches.

Accordingly, separate fans, i.e., the DC fan 46 and the AC evaporator fan 70, are provided for the fresh food compartment 14 and the freezer compartment 16 respectively of the refrigerator 10. In this way, the DC fan 46 and the AC evaporator fan 70 may be independently controlled. Accordingly, as compared to refrigerators using a single fan and a damper, (i) the response time between the call for cooling and the resulting discharge of cooling air into the fresh food compartment 14 is substantially reduced, (ii) fan speed, and therefore fan noise, may be reduced because two fans are used instead of one, and (iii) an overall energy reduction is realized because of the slower fan speeds and because a DC fan may be used for the fresh food compartment 14.

Certain modifications of the present invention have been discussed above. Other modifications will occur to those practicing in the art of the present invention. For example, the fan in the fresh food compartment 14 is described as a DC fan, and the fan in the freezer compartment 16 is described as an AC fan. Alternatively, both the fan in the fresh food compartment 14 and the fan in the freezer compartment 16 may be DC fans.

Moreover, the present invention is described above in relation to a refrigerator having top and bottom refrigeration compartments. However, the present invention is useful with side-by-side refrigeration compartments and with refrigerators having other refrigeration compartment configurations.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A multiple fan air distribution system for a refrigerator comprising:

first air discharging means for discharging cooled air to a first refrigeration compartment of a refrigerator, wherein the first air discharging means includes a first fan;

second air discharging means for discharging cooled air to a second refrigeration compartment of the refrigerator, wherein the second air discharging means includes a second fan; and, connecting means for interconnecting the first and second refrigeration compartments so that the first air discharging means discharges air from the second refrigerator compartment to the first refrigeration compartment, so that the first air discharging means discharges air to the first refrigeration compartment but not to the second refrigeration frigeration compartment, and so that the second air discharging means discharges air to the second refrigeration compartment but not to the first refrigeration compartment.

2. The multiple fan air distribution system of claim 1 wherein the connecting means comprises an air supply duct having a length so that the air supply duct extends from the second refrigeration compartment to the first refrigeration compartment of the refrigerator, and so that the first fan draws cooled air through the air supply duct from the second refrigeration compartment and discharges the cooled air to the first refrigeration compartment.

3. The multiple fan air distribution system of claim 2 wherein the second fan is arranged to circulate cooled air through the second refrigeration compartment of a refrigerator.

4. The multiple fan air distribution system of claim 3 wherein the second air discharging means is configured so that air may be circulated over an evaporator and discharged to the second refrigeration compartment of a refrigerator.

5. The multiple fan air distribution system of claim 4 wherein the first refrigeration compartment is a fresh food compartment of a refrigerator, and wherein the second refrigeration compartment is a freezer compartment of a refrigerator.

6. The multiple fan air distribution system of claim 5 wherein the first fan is a DC fan.

7. The multiple fan air distribution system of claim 6 wherein the connecting means comprises an air returning means for returning air from the first refrigeration compartment to the second refrigeration compartment of a refrigerator.

8. The multiple fan air distribution system of claim 7 wherein the air supply duct is a first air duct, and wherein the air returning means comprises:

an air inlet vent in the second refrigeration compartment; and, a second air duct having a length so that the second air duct may extend between the first refrigeration compartment and the air inlet vent in the second refrigeration compartment of a refrigerator.

9. The multiple fan air distribution system of claim 1 wherein the second air discharging means is configured so that air may be circulated over an evaporator and discharged to the second refrigeration compartment of a refrigerator.

10. The multiple fan air distribution system of claim 9 wherein the first refrigeration compartment is a fresh food compartment of a refrigerator, and wherein the second refrigeration compartment is a freezer compartment of a refrigerator.

11. The multiple fan air distribution system of claim 10 wherein the first fan is a DC fan.

12. The multiple fan air distribution system of claim 1 wherein the first fan is a DC fan.

13. The multiple fan air distribution system of claim 1 further comprising a first temperature sensor located so as to sense temperature in the first refrigeration compartment and arranged to control the first fan, and a second temperature sensor located so as to sense temperature in the second refrigeration compartment and arranged to control the second fan.

14. The multiple fan air distribution system of claim 1 wherein the first refrigeration compartment is a fresh food compartment, and wherein the second refrigeration compartment is a freezer compartment.

15. A refrigerator having a multiple fan air distribution system, the refrigerator comprising:

a refrigerator cabinet, wherein the refrigerator cabinet has first and second refrigeration compartments;

a first fan, wherein the first fan is located in the first refrigeration compartment and is arranged to draw cooled air from the second refrigeration compartment and to discharge the drawn cooled air to the first refrigeration compartment; and, a second fan, wherein the second fan is located in the second refrigeration compartment and is arranged to discharge cooled air to the second refrigeration compartment.

16. The refrigerator of claim 15 further comprising an air supply duct extending from the second refrigeration compartment to the first refrigeration compartment, wherein the first fan is arranged to draw cooled air through the air supply duct from the second refrigeration compartment and to discharge the cooled air to the first refrigeration compartment.

17. The refrigerator of claim 16 wherein the second fan is arranged to circulate cooled air through the second refrigeration compartment.

18. The refrigerator of claim 17 further comprising an evaporator, wherein the second fan is arranged to circulate air over the evaporator and through the second refrigeration compartment.

19. The refrigerator of claim 18 wherein the first refrigeration compartment is a fresh food compartment, and wherein the second refrigeration compartment is a freezer compartment.

20. The refrigerator of claim 19 further comprising an air return, wherein the air return is arranged to return air from the first refrigeration compartment to the second refrigeration compartment.

21. The refrigerator of claim 20 wherein the first fan is a DC fan.

22. The refrigerator of claim 15 further comprising an evaporator, wherein the second fan is arranged to circulate air over the evaporator and through the second refrigeration compartment.

23. The refrigerator of claim 22 wherein the first refrigeration compartment is a fresh food compartment, and wherein the second refrigeration compartment is a freezer compartment.

24. The refrigerator of claim 23 wherein the first fan is a DC fan.

25. The refrigerator of claim 15 wherein the first fan is a DC fan.

26. The refrigerator of claim 15 further comprising a first temperature sensor located so as to sense temperature in the first refrigeration compartment and arranged to control the first fan, and a second temperature sensor located so as to sense temperature in the second refrigeration compartment and arranged to control the second fan.

27. The refrigerator of claim 15 wherein the first refrigeration compartment is a fresh food compartment, and wherein the second refrigeration compartment is a freezer compartment.

28. A refrigerator comprising:

a refrigerator cabinet, wherein the refrigerator cabinet has first and second refrigeration compartments, and wherein each of the first and second refrigeration compartments has upper and lower portions;

a first air duct extending from the upper portion of the second refrigeration compartment to the upper portion of the first refrigeration compartment;

a second air duct extending between the lower portion of the second refrigeration compartment and the lower portion of the first refrigeration compartment;

a first fan, wherein the first fan is arranged to draw first air through the first air duct from the upper portion of the second refrigeration compartment and to discharge the first air into the upper portion of the first refrigeration compartment; and, a second fan, wherein the second fan is arranged to draw second air from the lower portion of second refrigeration compartment and to discharge the second air into the upper portion of the second refrigeration compartment.

29. The refrigerator of claim 28 further comprising an evaporator, and wherein the second fan is arranged to circulate air over the evaporator and to discharge the second air into the upper portion of the second refrigeration compartment.

30. The refrigerator of claim 29 wherein the first refrigeration compartment is a fresh food compartment, and wherein the second refrigeration compartment is a freezer compartment.

31. The refrigerator of claim 30 wherein the first fan is a DC fan.

32. The refrigerator of claim 28 wherein the first fan is a DC fan.

33. The refrigerator of claim 28 further comprising a first temperature sensor located so as to sense temperature in the first refrigeration compartment and arranged to control the first fan, and a second temperature sensor located so as to sense temperature in the second refrigeration compartment and arranged to control the second fan.

34. The refrigerator of claim 28 wherein the first refrigeration compartment is a fresh food compartment, and wherein the second refrigeration compartment is a freezer compartment.

* * * * *